United States Patent [19]

Blank et al.

[11] 4,337,521

[45] Jun. 29, 1982

[54] ADVANTAGEOUS GARNET BASED DEVICES

[75] Inventors: Stuart L. Blank; Ernst M. Gyorgy, both of Madison; Roy C. LeCraw, Westfield; Lars C. Luther, Basking Ridge, all of N.J.

[73] Assignee: Bell Telephone Laboratories, Incorporated, Murray Hill, N.J.

[21] Appl. No.: 106,399

[22] Filed: Dec. 26, 1979

[51] Int. Cl.[3] ..... H01F 1/37

[52] U.S. Cl. ..... 365/33; 252/62.57; 427/128; 428/692; 428/900

[58] Field of Search ..... 428/900, 692; 365/33, 365/34; 252/62.57; 427/128

[56] References Cited

U.S. PATENT DOCUMENTS

| | | | |
|---|---|---|---|
| 3,755,796 | 8/1973 | Griest, Jr. | 365/33 |
| 3,932,688 | 1/1976 | Sugita et al. | 365/33 |
| 3,995,093 | 11/1976 | Heinz | 252/62.57 |
| 4,034,358 | 7/1977 | Blank | 365/33 |
| 4,138,530 | 2/1979 | Breed et al. | 428/539 |
| 4,139,905 | 2/1979 | Blank et al. | 428/900 |
| 4,183,999 | 1/1980 | Otal et al. | 428/900 |
| 4,202,932 | 5/1980 | Chen et al. | 428/900 |

FOREIGN PATENT DOCUMENTS

| | | | |
|---|---|---|---|
| 2042950 | 3/1972 | Fed. Rep. of Germany | 252/62.57 |
| 2833891 | 2/1979 | Fed. Rep. of Germany | 365/34 |
| 2094608 | 1/1972 | France | 252/62.57 |

OTHER PUBLICATIONS

Krumme et al., "Control of the Uniaxial Magnetic Anisotropy in LPE-Grown Iron Garnet Films", Journal of Applied Physics, vol. 46, No. 6, 6/1975, pp. 2801–2803.

*Primary Examiner*—Stanley S. Silverman

*Attorney, Agent, or Firm*—Bruce S. Schneider

[57] ABSTRACT

Devices based on epitaxial garnet layers which exhibit a substantial contribution to the magnetic anisotropy other than that attributable to the presence of magnetic rare earth ions are disclosed. These garnet layers are produced by introducing $Co^{2+}$ or a species with 1, 2, 4, or 5 electrons in a 4d or 5d electronic orbital in the octahedral site of the garnet. It is possible to produce epitaxial garnets having low damping constants, as determined by resonance line widths on the order of 100 Oe, and $K_u$'s on the order of 300,000 ergs/cm$^3$.

12 Claims, 1 Drawing Figure

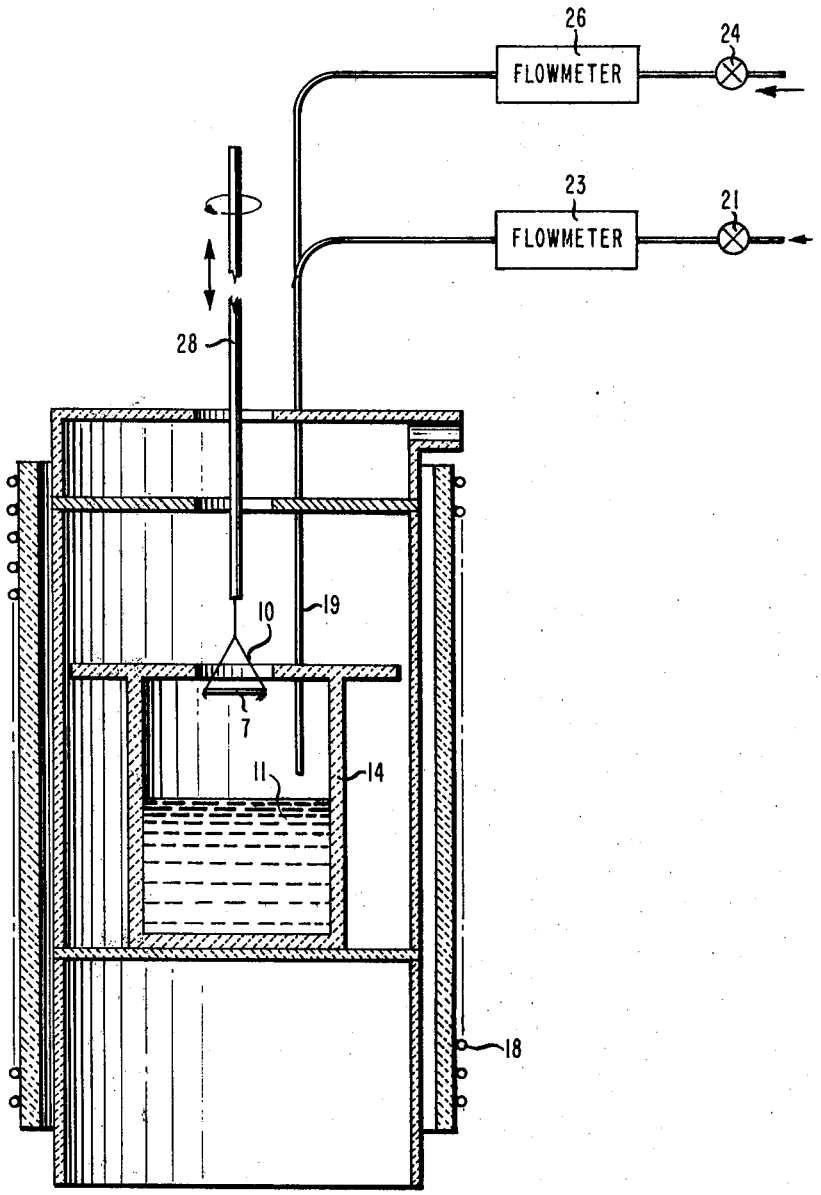
26
FLOWMETER
24
23
FLOWMETER
21
28
10
19
7
11
14
18

ADVANTAGEOUS GARNET BASED DEVICES

BACKGROUND OF THE INVENTION

1. Field of the Invention

This invention relates to devices relying on magnetic properties and, more particularly, those which in operation rely on magnetic properties to support single wall magnetic domains.

2. Art Background

An integral part of any magnetic bubble device is a layer of a material that has magnetic anisotropy which is capable of supporting single wall magnetic domains. One general class of such domain supporting materials has a garnet crystal structure. Thus, the interest in magnetic devices has generated a corresponding interest in garnet materials exhibiting the necessary anisotropy. While, for these materials anisotropy is one very significant property, a material simultaneously yielding the desired anisotropy and the rapid propagation of single wall magnetic domains is even more significant.

To a certain extent, the two desirable properties of high mobility and the requisite anisotropy are mutually exclusive. Growth induced uniaxial anisotropy is generally produced by the introduction of at least two rare earth (rare earth for the purpose of this discussion includes yttrium) ions at least one of which is magnetic, e.g., samarium, in the dodecahedral site of the garnet crystal lattice. To achieve practical growth induced uniaxial anisotropy, i.e., $K_u$'s greater than 7000 ergs/cm$^3$ ($K_u$ being defined as the energy expended per unit volume to rotate a magnetic material in a saturating magnetic field from normal to parallel to the field) the use of magnetic rare earth elements has been essential. However, the presence of a magnetic rare earth element in concentrations necessary to produce a desirable level of anisotropy also tends to restrict the mobility of single wall magnetic domains in the garnet material.

The interdependence of magnetic anisotropy and mobility for present garnet materials produces some limitations. Probable advances in fabrication techniques for bubble devices will allow use of smaller and smaller single wall magnetic domains. The exploitation of this new range of domain size is quite desirable since smaller magnetic domains allow the storage of a greater amount of information in a given area of magnetic garnet material. Nevertheless, the stability of small magnetic domains relies on the use of materials having very high $K_u$'s. As discussed previously, the use of high $K_u$'s may limit mobility, and in turn limit the speed at which stored data is processed.

SUMMARY OF THE INVENTION

Devices based on a new genera or garnet materials having the requisite magnetic anisotropy have been found. Additionally, devices utilizing garnets within this class offer the simultaneous possibility of high mobility and high magnetic anisotropy ($K_u$ up to 450,000 ergs/cm$^3$) in the substantial absence of magnetic rare earth ions. The garnets used in the inventive devices show line widths as low as 20 Oe for a sample with $K_u$ of 75,000 ergs/cm$^3$ as compared to a line width of approximately 400 Oe in a $Sm_{0.6}Lu_{0.9}Y_{1.5}Fe_5O_{12}$ having approximately the same $K_u$ and $M_s$. (Mobilities can be discerned by the microwave resonance method, where the measured line width is inversely proportional to the mobility.) The garnet material employed has anisotropy produced by ions on octahedral sites. These ions include $Co^{2+}$ or ions which have either 1, 2, 4, or 5 electrons in the 4*d* or 5*d* electronic orbital. The subject garnet material thus has a substantial growth induced contribution to the magnetic anisotropy not attributable solely to the presence of a magnetic rare earth ion.

BRIEF DESCRIPTION OF THE DRAWING

The FIGURE is a schematic representation of an apparatus used to fabricate garnet components of the inventive devices.

DETAILED DESCRIPTION

The devices of the subject invention are typically fabricated on a supporting substrate. Any mismatch in lattice parameters between the substrate and the garnet epilayer is a source of stress. This stress induces a magnetic anisotropy in the subject garnet materials. Substantial stress and thus substantial stress induced uniaxial anisotropy is not desirable. For example, assuming a typical magnetostriction constant, to maintain magnetic domains of useful size solely with stress induced magnetic anisotropy requires a large lattice mismatch between the substrate and the epitaxial layer—greater than $-0.015$ Angstroms for garnet materials with negative magnetostriction and $+0.02$ for material with positive magnetostriction in films of approximately $3\mu$. These large mismatches usually result in cracking or dislocated growth.

It is thus advantageous that stress and thus stress induced magnetic anisotropy be limited. Generally, the stress induced component of the magnetic anisotropy should be less than 15,000 ergs/cm$^{-3}$, preferably less than 10,000 ergs/cm$^{-3}$. (The extent of the stress induced component of the epitaxial layer is measured by conventional techniques such as by annealing out the growth induced anisotropy and measuring the remaining $K_u$. See R. C. LeCraw et al, *Journal of Applied Physics,* 42, 1641 (1971).)

The composition of the garnet layer grown on the substrate in accordance with the subject invention is represented by the nominal formula $\{A\}_3[B]_2(C)_3O_{12}$. The { }, [ ], and ( ), respectively represent the dodecahedral, the octahedral, and the tetrahedral site of the garnet crystal structure. The formula is nominal. To insure charge neutrality or because of growth defects, it is possible some slight deviations from strict stoichiometric ratios occur. The letters A, B, and C individually represent the average composition found in the designated crystal site. Since the crystal must have a magnetic moment, for compositions of general interest, both B and C should typically include iron ions although the requisite moment produced by iron solely on B or C is not precluded if another magnetic ion is present on the B or C site to produce the necessary magnetic moment. The invention requires, however, that in addition to other ions either $Co^{2+}$ and/or an ion having 1, 2, 4, or 5 electrons in a 4*d* or 5*d* electronic orbital is present on an octahedral site. Exemplary of ions having appropriate 4*d* or 5*d* orbitals are $Ir^{4+}$ and $Ru^{3+}$.

Charge neutrality must be maintained in the garnet. When an ion having a 3+ charge is introduced into the garnet on an octahedral site, it replaces a 3+ iron ion and charge neutrality is not disturbed. However, if an ion having a charge other than 3+ replaces an iron ion a net charge change in the garnet occurs and compensation is necessary. In a preferred embodiment, a charge compensator is introduced on the octahedral site. Exemplary charge compensators (those having, for example, a charge of $4^+$ to compensate for a $2^+$ ion and a charge of $2^+$ to compensate for a $4^+$ ion) are $Mg^{2+}$ and $Fe^{2+}$, which compensate for $4^+$ ions such as $Ir^{4+}$, and $Zr^{4+}$ which compensates for $2^+$ ions such as $Co^{2+}$.

Substitution in some octahedral and tetrahedral sites by ions other than those enumerated above to adjust the magnetic properties desired for a particular application is also possible. The limitation on this substitution is that sufficient iron remains in the octahedral and/or tetrahedral sites to produce a net magnetic moment. Similarly, enough of the requisite ion must be left on the octahedral sites to produce the desired anisotropy.

As discussed, the introduction of $Co^{2+}$ or ions having the appropriate 4*d* or 5*d* orbital configuration produces the desired anisotropy. (This anisotropy may be parallel to the plane of the film as in the case of a $Ru^{+3}$ substituted garnet when grown on a (111) oriented substrate. Materials with in plane anisotropy are useful, for example, as hard bubble suppressors when underlying or overlying a material with anisotropy out of the plane.)

As in other garnet structures, the composition of A, i.e., those entitles occupying the dodecahedral site influences the magnetic anisotropy. In the garnets employed in the subject invention, the substantial presence of a typical magnetic anisotropy producing combination is avoided, i.e., where $X_{3-y}Z_y$ represents the occupants of the dodecahedral site, A, and where X is the magnetic rare earth ion of highest mole percent in A and Z are the remaining constituents of A, the combination avoided is the presence of $X_{3-y}Z_y$ in which $0.1<y<2.9$, preferably in which $0.05<y<2.95$. Thus, unlike prior known devices, the magnetic anisotropy obtained in the subject garnet is substantially attributable to sources other than the substantial presence of a magnetic rare earth ion in combination with another ionic entity, i.e., the garnet is substantially devoid of the typical combination of rare earth ions capable of producing uniaxial anisotropy. In this way, the lower mobility usually attributed to typical combinations is also avoided.

Although the inventive garnets substantially avoid a typical magnetic anisotropy producing combination they exhibit growth induced $K_u$'s in excess of 7000 ergs/cm$^{-3}$ typically in excess of 50,000 ergs/cm$^{-3}$. Indeed, $K_u$'s up to 200,000 ergs/cm$^3$, and even up to approximately 450,000 ergs/cm$^3$, are produced.

Various means are available for growing the desired garnet structure. Epitaxial growth procedures employing a supercooled melt show good results. However, other methods are not precluded. In a preferred embodiment, to deposit a garnet of a desired composition, the substrate, 7, is placed in a substrate holder, 10, of a conventional epitaxial growth apparatus as shown in the FIGURE. The basic deposition steps are conventional and are described in various publications such as S. L. Blank and J. W. Nielsen, *Journal of Crystal Growth,* 17, 302–11 (1972). Briefly, in the preferred embodiment the melt is heated for a sufficient period to allow equilibration of its components. The temperature of the melt is then lowered to supercool it. The substrate is introduced above the melt to preheat it and then is lowered into the melt. During growth, in a preferred embodiment, the substrate is rotated through rotation of rod, 28.

The choice of the melt composition used in the deposition process relies on essentially the same considerations employed when conventional garnet layers are fabricated. (See S. L. Blank et al, *Journal of the Electrochemical Soc.,* 123, (6), 856 (1976) and Blank and Nielsen, *Journal of Crystal Growth,* 17, 302–11 (1972).) As with conventional garnets, the melt composition is adjusted to produce the desired formulation for A, B, and C. For example, for a garnet useful in the inventive devices such as $Y_3Fe_{5-x}Ir_xO_{12}$, iron to yttrium ratios in the melt in the range 12 to 40 are usually employed with the addition of an iridium containing substance e.g., $IrO_2$, in a quantity sufficient to produce an Ir to Fe atomic ratio in the melt in the range $5\times10^{-4}$ to $3\times10^{-2}$. For such compositional ranges, deposition temperatures in the range 750 to 1050 degrees C are advantageously utilized.

In the example of $Y_3Fe_{5-x}Ir_xO_{12}$, it is contemplated that $Fe^{2+}$ is the compensator for the $Ir^{4+}$. Thus, in this situation, although no extra component need be added to the melt the presence of $Fe^{2+}$ is required. Under atmospheric conditions, i.e., air at standard temperature and pressure, $Fe^{2+}$ is always present and is incorporated into the garnet as a compensator. However it is possible to introduce other compensators, e.g., $Zn^{2+}$ and $Mg^{2+}$, into the grown garnet by adding an appropriate oxide, e.g., MgO or ZnO, to the melt. Typically, added compensator-to-anisotropy-producing-entity ratios in the melt up to 100-to-1 are employed. For example, Mg to Ir ratios up to 100-to-1 are used to produce the necessary compensation for a composition such as $Y_3Fe_{5-2x}Ir_xMg_xO_{12}$. It has been found that these added compensators increase the obtainable Ku. A contemplated explanation is that they increase the amount of available compensator and thus increase the amount of anisotropy producing ion which it is possible to incorporate in the crystal. It is also possible to introduce various ions into the melt to produce certain desired properties in the resulting garnet. For example, to adjust the lattice constant to closely match that of a $Gd_3Ga_5O_{12}$ garnet (GGG) or another desired substrate material, appropriate ions, e.g., lanthanum or lutetium is added to a melt containing yttrium, iron and iridium. Similarly, it is possible to lower the $M_s$ of the garnet by adding ions such as Ga. The optimum melt composition to yield a desired garnet composition is determined by employing the criteria of Blank et al supra as an initial guide and then by using a controlled sample to fix the precise melt composition.

Generally, the garnets are produced in an air environment. However, there are certain limited situations where it may be desirable to change the environment over the melt and, thus, to control the specie in the melt itself. In a preferred embodiment, this environment is controllable by introducing the desired gases through tube, 19, using valves 21 and/or 24 and flowmeters 23 and 26. Generally, this control is necessary when a specie desired to be introduced into the garnet is not stable in the melt under atmospheric conditions. For example, in the case of the compensator $Fe^{2+}$, at atmospheric pressure, the equilibrium of $Fe^{3+}$ and $Fe^{2+}$ is shifted strongly to the former species. Thus, if the environment is made more reducing than atmospheric conditions, i.e., is kept at an oxygen partial pressure in the range $10^{-4}$ atm to $10^{-3}$ atm, a greater amount of $Fe^{2+}$ is present in the melt and, thus, a greater amount of $Fe^{2+}$ is available for incorporation into the garnet as a compensator. Indeed, it has been found that for an $Fe^{2+}$ compensator, maximum $K_u$ is achieved at an $O_2$ partial pressure of approximately 0.1 atm. (It should be noted that if it is desired to adjust the $O_2$ partial pressure of the atmosphere, it is conveniently done by introducing gases such as a $CO/CO_2$ mixture. The relation between the partial pressure of $O_2$, CO, and $CO_2$ at a given temperature is well known. See Muon and Aborn, *Phase Equilibria Among Oxides in Steelmaking,* Addison Wesley (1965).) It is believed that the presence of a larger amount of compensator, in turn, allows the addition of a larger amount of appropriate anisotropy producing ion.

However, this phenomena reaches a saturation point. There is a limit to the amount of anisotropy producing ion which will substitute into the garnet irrespective of the amount of compensator available. Additionally, as the environment is made more reducing, it is possible to effect the anisotropy producing ion. For example, iridium has both a $3+$ and $4+$ oxidation state. If the atmosphere is made too reducing, the $3+$ specie or elemental iridium will predominate and limit the amount of $4+$ ion available for incorporation in the garnet.

Since control complications occur when an environment other than air at atmospheric conditions is utilized, it is preferred to employ compensators such as $Mg^{2+}$. Magnesium has only one oxidation state that is stable under atmospheric conditions and thus the effects and difficulties associated with adjusting the atmosphere are eliminated.

Once the garnet layer is deposited, it is possible to provide a means for propagating magnetic bubbles in the garnet. Typically, this means is a permalloy pattern which is deposited on the garnet layer using conventional lithographic techniques. (See, for example, Bobeck et al, *Proceedings of the IEEE,* 63, 1176 (1975).) Additionally, a means of detecting single wall domains and of producing these domains is also required. Typically, the detector is fabricated using standard lithographic techniques to produce an appropriate permalloy pattern. Similarly, a single wall magnetic domain nucleator is produced by lithographic techniques. (See Bobeck et al, supra.) A means for maintaining the single wall magnetic domains after its nucleation is also required as a component of a bubble device. This means is generally a permanent magnet surrounding the garnet layer with its associated detecting, propogating, and nucleating means.

The following are examples of typical conditions utilized in the deposition of the garnet epitaxial layer:

EXAMPLE 1

A circular GGG ($Gd_3Ga_5O_{12}$) substrate measuring 2 inches in diameter and 20 mils thick was used as the deposition substrate. This substrate, 7, was cleaned, dried, and then inserted in the substrate holder, 10, (see the FIGURE) of an apparatus containing a previously prepared melt composition, 11. This melt composition was prepared by inserting a mixture of approximately 7.50 grams $Y_2O_3$, 90.0 grams $Fe_2O_3$, 22.5 grams $B_2O_3$, 1050 grams PbO, and 2.59 grams $IrO_2$, in a platinum crucible, 14. The melt was heated using resistant heating coils, 18, to a temperature of approximately 1020 degrees C.

Once a temperature of 1020 degrees C. was established the melt, 11, was allowed to react for a period of approximately 16 hours. The temperature of the melt was then lowered to a growth temperature of approximately 915 degrees C. The substrate was lowered to within 1 cm of the melt surface by lowering rod, 28. The substrate was maintained in this position for approximately 6 minutes. The substrate was then immersed approximately 2 cm into the melt by again lowering rod, 28, and a rotation of 100 rpm was imparted to the substrate through rod, 28. This rotation was maintained for approximately 5 minutes and the substrate then removed from the melt to a position 1 cm above the melt while continuing the rotation. The rotation was then increased to 400 rpm for a period of $\frac{1}{2}$ minute. The rotation was discontinued and the substrate removed from the deposition area by extracting rod, 28, at a rate of approximately $\frac{1}{2}$ cm/min.

A continuous adherent garnet film was obtained. This film had a thickness of approximately 9 $\mu$m and exhibited a $K_u$ of approximately 85000 ergs/cm$^3$, a line width of approximately 25 Oe, and a lattice constant of within 0.002 Angstroms of the substrate lattice parameter.

EXAMPLE 2

A series of five garnets with varying amounts of Ir ($Mg^{2+}$ compensated) were grown to indicate the magnitude of obtainable magnetic anisotropies. The experimental conditions were the same as indicated in Example 1, except the melt contained 2.56 grams $Y_2O_3$, 30.0 grams $Fe_2O_3$, 7.18 grams $B_2O_3$, 350 grams PbO, and 1.00 grams MgO. Various amounts of $IrO_2$ were added to this melt. The total amounts of Ir present in the melt (not considering the Ir incorporated in the grown epilayers) and the $K_u$ obtained for the garnet grown in that run are in the following table:

TABLE

| SAMPLE | TOTAL GRAMS OF $IrO_2$ | $K_u$ (Ergs/cm$^3$) |
|---|---|---|
| I | .16 | 60,000 |
| II | .47 | 130,000 |
| III | 1.07 | 270,000 |
| IV | 1.44 | 340,000 |
| V | 2.00 | 380,000 |

The lattice parameter of these films increased approximately linearly from a value of 12.38 Angstroms for the film of Sample I to about 12.400 Angstroms for the film of Sample V. As can be seen from the table, the $K_u$'s will not increase indefinitely and it appears a saturation point is reached for Ir production of $K_u$. The amount of Ir at saturation was found to be dependent on the amount of MgO present. A garnet was grown from a melt having the same composition as Samples I through V, except 1.61 grams of MgO and 2.41 grams of $IrO_2$ were utilized. The use of this combination produced a $K_u$ of approximately 450,000 ergs/cm$^3$. It was found, however, that addition of further MgO in conjunction with a suitable increase of $IrO_2$ did not substantially increase the $K_u$'s obtained. Therefore, it appeared that saturation for Mg and/or Ir in the crystal occurred under these growth conditions.

EXAMPLE 3

To demonstrate that the magnetic properties of the subject films are controllable by addition of various materials to the melt, a garnet film that contained Ga and La was produced. The Ga was added to adjust the magnetic moment and the La to adjust the lattice parameter. This film was grown from a melt containing 7.51 grams $Y_2O_3$, 3.29 grams $La_2O_3$, 15.56 grams $Ga_2O_3$, 80.0 grams $Fe_2O_3$, 36.2 grams $B_2O_3$, 1900 grams PbO, 0.418 grams $IrO_2$, and 0.505 grams MgO. The experimental conditions used for the growth of this garnet were the same as those employed in Example 1, except the equilibration temperature was 950 degrees C. and the growth temperature was 844 degrees C. The growth was continued for 8 minutes to produce a 2.0 μm thick layer. The magnetic moment obtained was 230 Gauss, the $K_u$ was 9000 ergs/cm$^3$, and the dynamic coercivity was approximately 3 O e. (The size of the anisotropy was low since only a small amount of $IrO_2$ was utilized in the melt. However, single wall domains were produced and observed.)

EXAMPLE 4

The procedure of Example 1 was followed except the melt composition utilized was 3.50 grams $Y_2O_3$, 30.0 grams $Fe_2O_3$, 3.01 grams $ZrO_2$, 7.7 grams $B_2O_3$, 350 grams PbO, and 4.00 grams $Co_3O_4$. Additionally, the growth temperature utilized was approximately 915 degrees C. A growth time of 3 minutes produced a 7.0 μm thick garnet. A $K_u$ of approximately 165,000 ergs/cm$^3$ was observed in this cobalt containing garnet. The garnet was then annealed at 1150 degrees C. for 19 hours in air after which a $K_u$ of approximately 10,000 ergs/cm$^3$ was observed.

We claim:

1. A device comprising (1) an epitaxial layer of garnet material having a uniaxial magnetic anisotropy greater than 7000 ergs/cm$^3$ which due to a growth induced component is capable of supporting a single wall magnetic domain (2) means for producing and means for maintaining in said garnet said single wall magnetic domain (3) means for propagating said single wall magnetic domain in said garnet and (4) means for detecting the presence of said single wall magnetic domain, such that said garnet material comprises a composition nominally represented by the formula $\{A\}_3\ [B]_2\ (C)_3\ O_{12}$, wherein said composition includes sufficient iron ions to produce a magnetic moment in said garnet characterized in that B also includes a member of the group consisting of $Co^{2+}$ and an ion having *5d* or *4d* electrons wherein the number of said electrons is 1, 2, 4 or 5, and A is substantially devoid of a typical combination capable of producing a magnetic anisotropy, said typical combination represented by A being $X_{3-y}Z_y$ where X is the magnetic rare earth ion of highest mole fraction in A, Z is the remaining composition of A, and $0.1<y<2.9$.

2. The device of claim 1 wherein said ion is a charged specie of iridium.

3. The device of claim 1 wherein said ion is a charged specie of ruthenium.

4. The device of claim 1 wherein said garnet material has a $K_u$ greater than 50,000.

5. The device of claim 1 wherein said garnet contains a charge specie of Mg as a compensator.

6. A device comprising a substrate with an epitaxially deposited layer of garnet material, said garnet material having a uniaxial magnetic anisotropy greater than 7000 ergs/cm$^3$ which due to a growth induced component is capable of supporting a single wall magnetic domain, such that said garnet material comprises a composition nominally represented by the formula $\{A\}_3\ [B]_2\ (C)_3\ O_{12}$, where B and C include sufficient iron ions to produce a magnetic moment characterized in that B also includes a member chosen from the group consisting of $Co^{2+}$ and an ion having *5d* or *4d* electrons wherein the number of said electrons is 1, 2, 4 or 5, and A is substantially devoid of a typical combination capable of producing a magnetic anisotropy, said typical combination represented by A being $X_{3-y}Z_y$ where X is the magnetic rare earth ion of highest mole fraction in A, Z is the remaining composition of A, and $0.1<y<2.9$.

7. The device of claim 6 wherein said garnet material has a $K_u$ greater than 50,000.

8. The device of claim 6 wherein said garnet material includes a charged specie of Ir in B.

9. The device of claim 6 wherein said garnet material includes a charged specie of Ru in B.

10. The device of claim 6 wherein said substrate is GGG.

11. The device of claim 6 wherein said garnet contains a charged specie of yttrium in A.

12. A device comprising (1) an epitaxial layer of garnet material having a uniaxial magnetic anisotropy which due to a growth-induced component is capable of supporting a single wall magnetic domain (2) means for producing and means for maintaining in said garnet said single wall magnetic domain (3) means for propagating said single wall magnetic domain in said garnet and (4) means for detecting the presence of said single wall magnetic domain characterized in that the device includes a second garnet layer contacting said epitaxial layer of garnet material, said second garnet layer composed of a material represented by the formula $\{A\}_3\ [B]_2\ (C)_3\ O_{12}$, wherein B includes $Ru^{3+}$, and wherein A is substantially devoid of a typical combination capable of producing a magnetic anistropy, said typical combination represented by A being $X_{3-y}Z_y$ where X is the magnetic rare earth ion of highest mole fraction in A, Z is the remaining composition of A, and $0.1<y<2.9$.

* * * * *

UNITED STATES PATENT AND TRADEMARK OFFICE

CERTIFICATE OF CORRECTION

PATENT NO. : 4,337,521

DATED : June 29, 1982

INVENTOR(S) : Stuart L. Blank, Ernst M. Gyorgy, Roy C. LeCraw and Lars C. Luther It is certified that error appears in the above—identified patent and that said Letters Patent is hereby corrected as shown below:

Column 1, line 54, "or" should read --of--. Column 2, line 62, "3+" should read --$3^+$--. Column 3, line 23, "entitles" should read --entities--. Column 5, line 42, "propogating" should read --propagating--. Column 7, line 4, "O e" should read --Oe--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*